United States Patent [19]

Hoover et al.

[11] 4,166,589

[45] Sep. 4, 1979

[54] PORTABLE WRAPPING FILM DISPENSER

[75] Inventors: Lawrence E. Hoover, Clearwater, Fla.; George J. Reid, 2370 17th St., Cuyahoga Falls, Ohio 44223

[73] Assignee: George J. Reid, Akron, Ohio

[21] Appl. No.: 889,636

[22] Filed: Mar. 24, 1978

[51] Int. Cl.[2] ..... B65H 23/06; B44C 7/00

[52] U.S. Cl. ..... 242/75.4; 156/577; 242/55

[58] Field of Search ..... 242/55, 105, 75.4, 68.4, 242/99, 68, 67.1 R, 67.3, 156.2; 53/139.3; 156/577

[56] References Cited

U.S. PATENT DOCUMENTS

| | | | |
|---|---|---|---|
| 1,884,183 | 10/1932 | Pearson | 242/156.2 |
| 2,549,136 | 4/1951 | Simpson | 53/139.3 |
| 2,563,542 | 8/1951 | Mackelduff | 53/139.3 |
| 3,369,952 | 2/1968 | Rieger | 156/577 |
| 4,102,513 | 7/1978 | Guard | 242/75.4 |

*Primary Examiner*—Edward J. McCarthy
*Attorney, Agent, or Firm*—John J. Murphey

[57] ABSTRACT

A hand-held device for dispensing plastic film for wrapping stacked items including a hand-actuated braking mechanism to permit the holder to stretch the film as he winds it around a stack. The braking mechanism is actuated by rotation of one of the handles so that the stability of the roll is not affected during tensioning and wrapping.

14 Claims, 4 Drawing Figures

PORTABLE WRAPPING FILM DISPENSER

BACKGROUND OF THE INVENTION

This invention relates to the field of wrapping. More particularly, this invention relates to the field of plastic film for wrapping around stacks of material for storage and/or transportation.

DESCRIPTION OF THE PRIOR ART

Virtually all products from glassware and clothing to furniture and machinery are containerized between the manufacturer and the retailer. Paper boxes and bags are generally used for indoor storage and/or covered transportation. In many instances, however, indoor storage is unavailable and covered transportation is not feasible.

Recently, the discovery of inexpensive, thin plastic wrapping has provided manufacturers with an alternative means of storage. Pallets of stacked cardboard boxes of products may be completely enclosed with a tightly wrapped, continuous overlapping ribbon of waterproof plastic film to provide a combination of means for holding the stack in easily handled modules and means for protecting the individual cardboard boxes.

Where pallets of boxes are stacked in symmetrical configurations, they may be conveniently wrapped by a machine that rotates the pallet on a turntable and dispenses plastic film from a roll mounted nearby and adapted to traverse upward, from the bottom of the pallet to the top of the stacked material, providing an endless overlapped plastic ribbon encompassing the whole stack, see Packaging Sales & Development Corp., Automatic Multi-Roll Model, 180 Coolidge Ave., Englewood, N.J. 07631. Where, however, the pallet contains an uneven geometry of stacked products or where the item itself is non-symmetrical, the turntable film roll wrapping machine does not provide ideal wrapping as the non-symmetry causes areas of looseness in the film strip allowing some strips to fall or slip from their overlapping configurations resulting in noncovered portions on the stack that would be exposed to rain and snow.

SUMMARY OF THE INVENTION

This invention is a device for dispensing wrapping film from a roll and hand-holding the roll to permit it to be swung in an endless variety of directions and, at the same time, providing means for restricting the dispensing of the film so as to tension it against the stacked material to accommodate symmetric as well as non-symmetric configurations. This invention is adaptable to handle plastic wrapping film rolls of varying length, the ultimate limitation therein being the strength of the person using the device. The means for restricting the dispensing of the film from the roll is mechanically actuated by rotating one of the handles with respect to the other, thus providing the user with means for holding the film roll and applying tension thereto simultaneously without letting go of one or both of the handles.

Accordingly, one object of this invention is a portable device for dispensing film from a roll. Another object of this invention is a portable device for dispensing plastic film that allows the user to tension the film as the film is being dispensed to enable the film to be stretched or tightened around the object being wrapped whether symmetrical or non-symmetrical. A further object is a portable device that is easily changed from one type of wrapping film to another for quick and efficient use of a wide variety of plastic films. A still further objective of this invention is a portable device for dispensing plastic film that is adaptable to handling rolls of varying length. These and other objects will appear more clearly below in the description of the preferred embodiments that is to be read along with the drawings that are made a part hereof, concluding with claims to the novel aspects of this invention.

DESCRIPTION OF THE PREFERRED EMBODIMENTS

Figure 1:
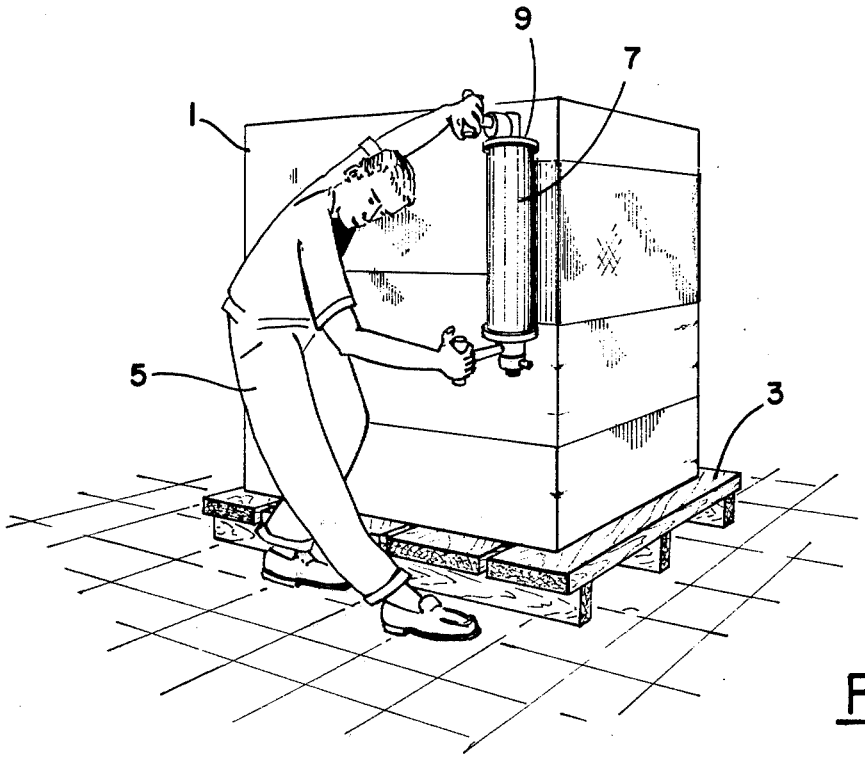
FIG. 1 is a drawing of a person using the portable device of this invention to wrap a pallet of material with film.

FIG. 1 shows a person correctly using this invention and shows a stack of material 1 situated on a pallet 3 and an operator 5 holding a roll of wrapping film 7 in one embodiment of this invention 9 and walking backward around material stack 1 pulling the wrapping film tightly into a series of overlapping spirals upward from pallet 3 so as to encase the material in a tightly wrapped ribbon of plastic film. Prior to beginning the wrapping, ordinary practice dictates that the operator would place separate sheets of wrapping material on top of the pallet before stacking the material thereon and place a sheet or a series of overlapping sheets across the top of stack 1 so that the spiral strips of material would encase loose ends of the film on top of the pallet and the film on the top of stack 1 to ultimately form a completely weather-tight covering about all exposed surfaces.

Figure 2:
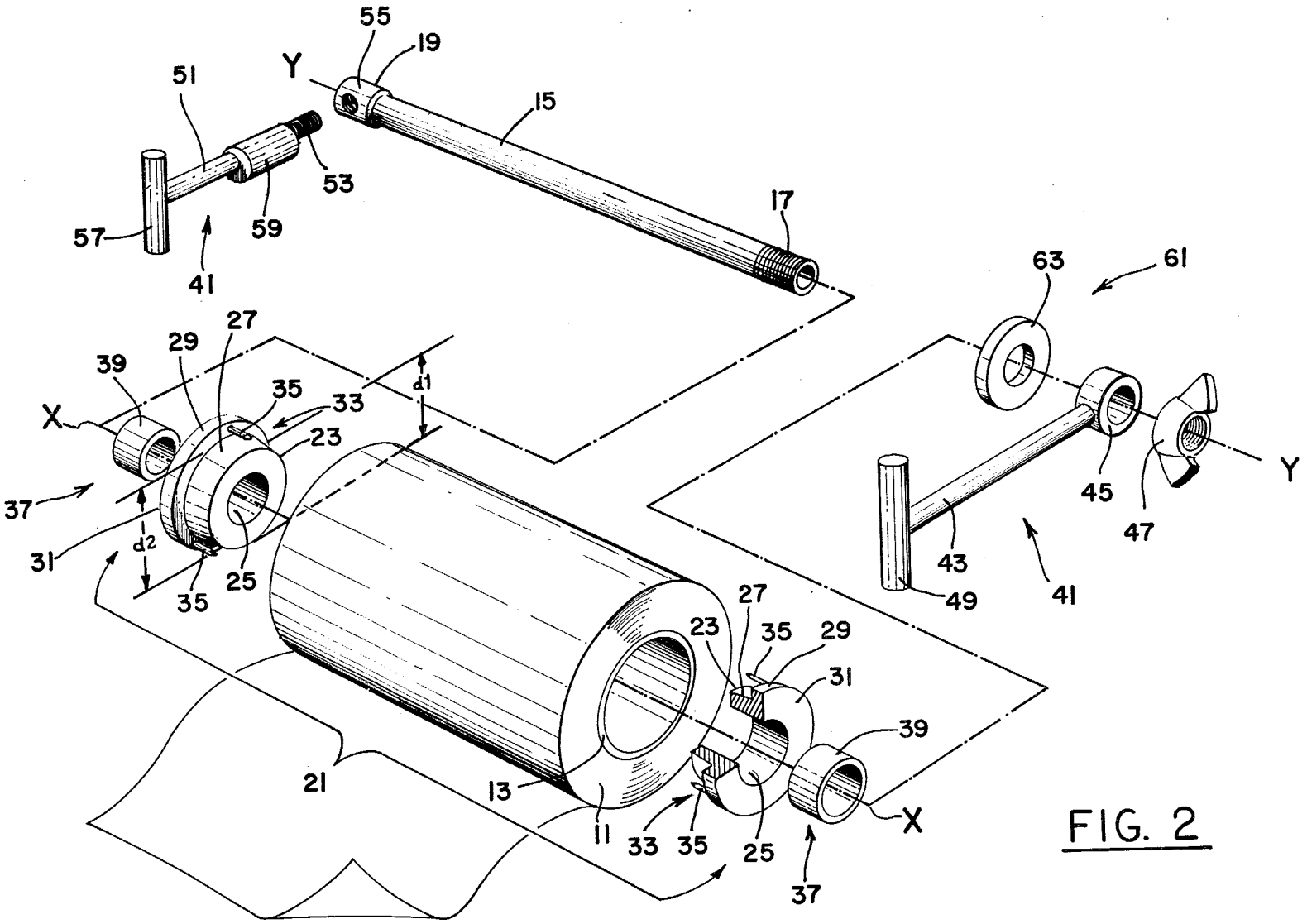
FIG. 2 is an exploded view of one embodiment of this invention.

FIG. 2 shows one embodiment of this invention and shows a conventional roll of plastic film 11 wrapped about a cylindrical cardboard center tube 13. These are readily available for purchase from a wide variety of film manufacturers. A roll-carrying bar 15, having terminal end portions 17 and 19, which may be a solid or hollow rod of any cross sectional configuration, but preferably a hollow aluminum tube for strength/weight economy, is positioned inside cardboard tube 13 so that axis X—X of tube 13 coincides with axis Y—Y of bar 15. Terminal bar end 17 has a series of threads formed therein. Means 21, for rotatably mounting roll 11 about bar 15, is slipped over bar 15 and rotatably and concentrically carried thereon for fixing to the ends of cardboard tube 13.

Means 21 is shown to comprise a pair of roll plugs 23 having central apertures 25 formed therethrough to rotatably receive bar 15 in concentric alignment therewith. Each plug 23 comprises mutually facing first inner roll end insertion portions 27, in the form of truncated cones whose innermost diameters d1 are slightly less than the inside diameter of cardboard tube 13 and whose outermost diameters d2 are equal to or slightly greater than the inside diameter of cardboard tube 13, for receipt inside the ends of cardboard tube 13 and second roll end abutting portions 29, of greater diameter than the inside diameter of cardboard tube 13, outboard of inner portions 27 that are adapted to abut the ends of cardboard tube 13. These roll end abutting portions 29 terminate in flat outer surfaces 31 perpendicular to axis Y—Y of bar 15.

Mounted on roll end abutting portion 29 are means 33 for attaching roll plugs 23 to the ends of cardboard center tube 13. As shown in FIG. 2, means 33 comprises a pair of inwardly facing pins 35 for penetration into the cardboard at the ends of cardboard center tube 13 to hold roll 11 and plugs 23 in mating engagement and to prevent roll 11 from turning about roll-bar 15 independent of roll plugs 23. Although a pair of pins 35 are shown in each of roll plugs 23, one pin would suffice. It is preferred for stability, however, that at least a pair of pins spaced 180° apart are used. Other fasteners, such as spring-loaded clips, glue, shims, or conventional spring clips may be used in means 25 without departing from the spirit and scope of this invention.

Optionally, bearing means 37 may be used to reduce the rotational friction between roll plugs 23 and roll-carrying bar 15. As shown in FIG. 2, bearing means 37 comprises a pair of sleeve bearings 39 interposed between aperture 25 and roll-carrying bar 15. Other bearings such as ball bearings, roller bearings or pin bearings could also be used in bearing means 37.

At the ends of roll-carrying bar 15 are positioned means 41 for hand-carrying bar 15. As shown in FIG. 2, means 41 comprises a first arm 43 extending from bar 15 and attached thereto outboard of roll plug 23 by a sleeve 45 received over the threaded end 17 of roll-carrying bar 15 and fastened thereon by wing nut 47 that is threaded onto bar end 17. A cross handle 49 extends transversally from the free end of first arm 43. A second arm 51 extends from the other end 19 of roll-carrying bar 15 and is pivotally anchored thereto by a pivot shaft 53 rotatably received through a bar end collar 55 that is received over bar end 19 and held therein by conventional means such as a rivet, nut threaded thereon, or other such means (not shown). A cross handle 57 extends transversally from the free end of second arm 51.

A brake cam 59 is formed on second arm 51 and adapted to contact flat outer surface 31 of adjacent roll plug 23, so as to move plug 23 toward its complementary end of cardboard tube 13 by rotating cross handle 57 with respect to cross handle 49.

Means 61, actuated by end-carrying means 41, for restricting the rotation of roll 11 about roll-carrying bar 15 to provide tension to the film as it is being dispensed from the roll, is shown in FIG. 2 to comprise a single friction-producing, compressible washer 63 received on the end of roll-carrying bar 15 between roll plug 23 and sleeve 45. As cross handle 57 is rotated about second arm 51 to cause brake cam 59 to press against adjacent roll plug 23, roll 11 and the two roll plugs 23 are forced along bar 15 toward first arm 43 thereby squeezing washer 63 between the adjacent flat outer surface 31 and sleeve 45 causing friction therebetween to slow the rotation of roll 11 about bar 15.

It is important that washer 63 be both friction producing and compressible. The frictional production aspect is to provide tension to the film and the compressional aspect is to provide a range of rotational friction as a function of how hard cross handle 57 is rotated. Washers of neoprene rubber, EPDM rubber, styrene-butadiene rubber and GRS rubber are quite operable whereas washers of Teflon (trademark) and Nylon (trademark) are not operable by themselves.

Figure 3:
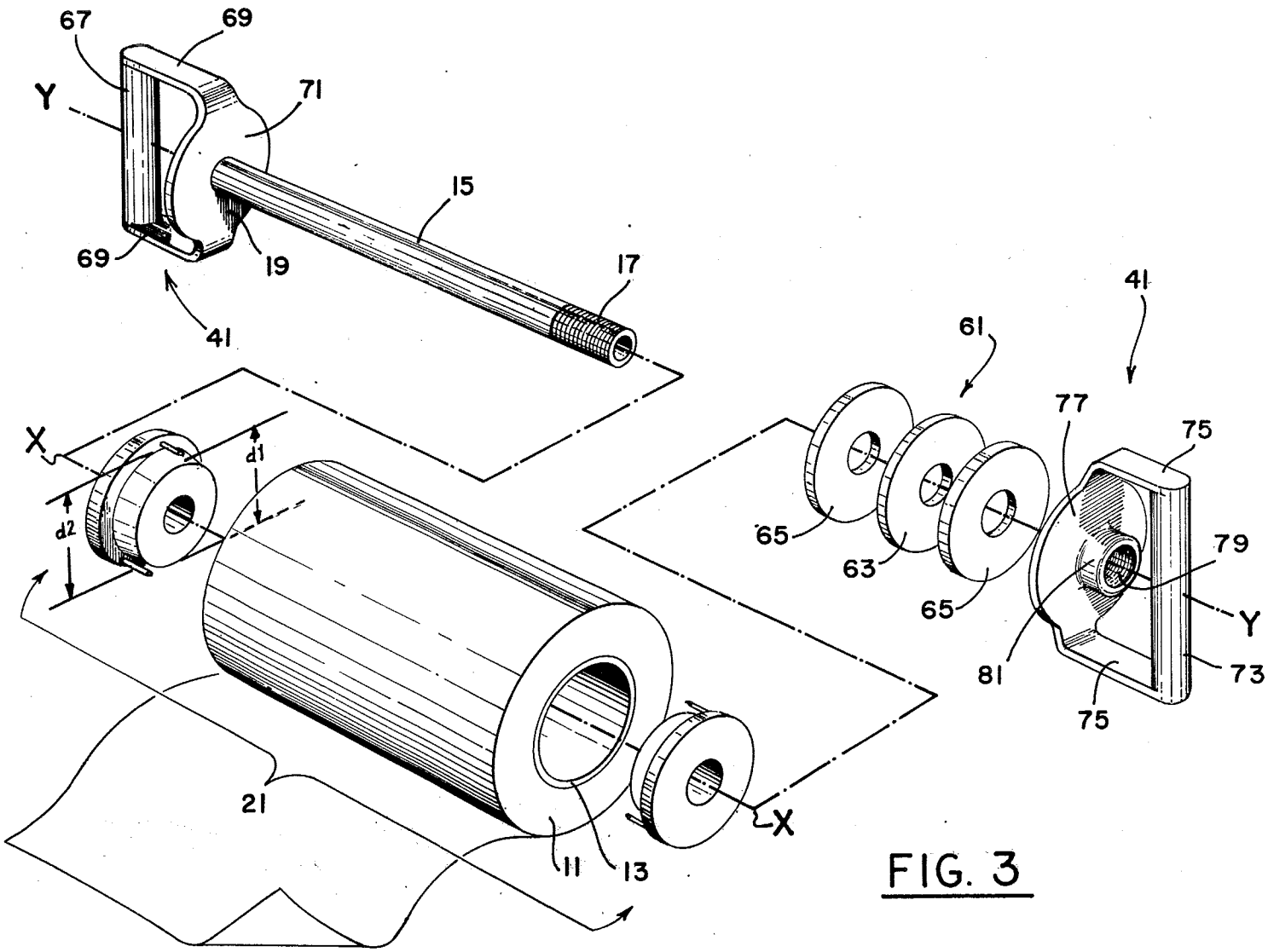
FIG. 3 is an exploded view of another embodiment of this invention.

Another embodiment of means 61 is shown in FIG. 3 where friction-producing, compressible washer 63 is sandwiched between two noncompressible washers 65, the three washer combination received on roll-carrying bar 15 between roll plug 23 and sleeve 45. This embodiment provides smoother film tensioning control over the embodiment shown in FIG. 2. Noncompressible washers of brass, Nylon (trademark), Teflon (trademark) work well in this embodiment.

Means 61 may also comprise a single washer 63 at each end of roll 11, received on bar 15 between flat outer surface 31 of each of roll plugs 23 and sleeve 45 on one end and bar end collar 55 on the other end. Cam 59 may then be caused to rotate into contact with washer 63 to not only force roll 11 and the two roll plugs 23 along bar 15 toward first arm 43 to squeeze washer 63 therebetween but also to, itself, press against washer 63 to provide additional rotational friction.

Also, means 61 may comprise two washers 63 respectively sandwiched between two pairs of washers 65 at both ends of roll bar 15 and be fully within the scope of this invention. Additionally, friction-producing, compressible washer 63 works operatively with a single noncompressible washer 65 on either side thereof received as aforesaid at either one end or both ends of bar 15 without departing from the spirit and intent of this invention.

FIG. 3 shows another embodiment of the invention and shows a second means 41 for hand carrying said device. The second embodiment comprises a first handle 67 bounded at the ends by a pair of arms 69 extending toward roll 11, the free ends of which join a first end plate 71. Plate 71 is perpendicular to axis Y—Y of roll-carrying bar 15 and attached to bar end 19 at the center thereof by any conventional means such as welding, riveting, threaded coupling or otherwise. A second handle 73 bounded at the ends by a pair of arms 75 extending toward roll 11, the free ends of which join a second end plate 77 having a central aperture 79 formed therein. Plate 77 is perpendicular to axis Y—Y of roll-carrying bar 15 and is threadably mounted on bar end 17 by an anchor nut 81 rigidly attached to plate 77 over aperture 79.

The device is assembled by mounting roll 11 between end plugs 23 and sliding plugs 23 over bar 15. Means 61, either the assembly of washers 63 and 65 or a combination thereof is slipped over one or both ends of bar 15. Restriction and rotational motion of roll 11 relative to hand-carrying means 41 is obtained by twisting handles 67 and 73 in opposite directions to advance or draw end plates 71 and 77 toward each other to tighten either end plate 77 or both end plates 71 and 77 against brake means 61 and against adjacent flat outer surface or surfaces 21. By twisting handles 67 and 73 in one set of opposite directions roll 11 is tightened therebetween and tension may be pulled in the film by the operator whereas by twisting handles 67 and 73 in the other set of opposite directions roll 11 is loosened to rotate with less restrictions thus providing the operator with the film stretching capability.

In FIG. 2, a first arm 43 and second arm 51 may be interchanged so that brake cam 59 can rotate against adjacent washer 63 or 65 to provide restriction of rotation of roll 11 without departing from the spirit and scope of this invention. In FIG. 3, first end plate 71 may optionally be threadably received on end 19 of roll-carrying bar 15 similar to second end plate 77 without departing from the spirit and scope of this invention.

Figure 4:
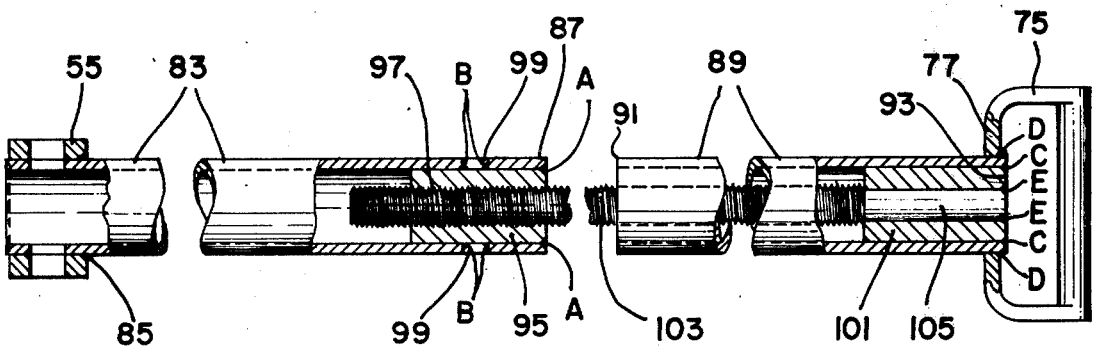
FIG. 4 is an isometric view of another embodiment of the roll-carrying bar of this invention.

In FIG. 4 is shown another embodiment of roll-carrying bar 15 that will cause this inventive device to accommodate rolls of different length. In this embodiment, roll-carrying bar 15 comprises a first roll-carrying tube stub 83, attached at one handle-adjacent end 85 to bar end collar 55 by welding or threading (or first end plate 71—see FIG. 3) and having an open end 87 at the other end. A second roll-carrying tube stub 89, having an open end 91 set apart open end 87 and a handle-adjacent end 93 attached to second end plate 77 by welding or threading (or left threaded for receipt of sleeve 45—see FIG. 2) is axially aligned thereto, the respective adjacent ends 87 and 91 remaining mutually separated. A plug 95, closely fitting the inside diameter of tube stub 83 is placed inside open stub end 87 and attached thereto by welding around circumference A—A and, optionally at apertures 99 formed in tube stub 83 at B—B. Said plug 95 forms an aperture 97 axially therethrough.

A similar plug 101 is received in handle-adjacent stub end 93 and attached thereto by welding around circumference C—C. Second end plate 77 is also attached to stub end 93 by welding around circumference D—D.

A threaded shaft 103, of smaller diameter than the inside diameter of the stubs 83 and 89 is anchored by welding at one end 105 to plug 101 at any place therealong such as around circumference E—E. Said shaft 103 is threadably received in plug aperture 97.

This embodiment will accommodate rolls of different length by unscrewing shaft 103 from plug 95, placing means 61 over one or both handle-adjacent stub ends 85 and 93, and threading shaft 103 back into plug 95 inside a roll that has both roll plugs 23 attached to the ends thereof. Hand-holding means 41 are then twisted to assemble all the parts and bring flat outer surfaces 31 of roll plugs 23 into contact with means 61 and sleeve 45, cam surface 59 or first and second end plates 71 and 77, whichever embodiment is chosen.

What is claimed is:

1. A portable device for dispensing wrapping film from a roll comprising:

(a) a roll-carrying bar;

(b) a pair of roll plugs rotatably disposed on said bar, each plug comprising:

(1) a first inner roll end insertion portion adapted to fit into the end of the roll to concentrically engage the inside surface thereof;

(2) a second roll end abutting portion attached thereto of greater diameter than the inside diameter of the roll, adapted to abut the end of the roll; and, (3) a flat outer surface formed on the outboard surface of said plug perpendicular to the axis of said roll-carrying bar;

(c) a pair of pins extending from said second roll end abutting portion toward the roll for penetration into the end of the cardboard roll to hold the roll in mating engagement with said plugs;

(d) a sleeve slideably received on one end of said roll-carrying bar and held thereon with a nut threadably received on said bar end;

(e) a first arm extending from said sleeve;

(f) a cross handle extending from the free end of said first arm;

(g) a second arm pivotally anchored to the other end of said roll-carrying bar and extending therefrom;

(h) a cross handle extending from the free end of said second arm;

(i) a brake cam formed on said second arm adapted to contact said flat outer surface of said adjacent plug; and, (j) at least one friction-producing, compressible washer slidably received on said bar between said second arm mounting sleeve and said flat outer plug surface of said adjacent roll plug to provide increased rotational friction between the roll and said cross handles when squeezed between said sleeve and said outer plug surface upon said brake cam being rotated into contact with said flat outer surface of said adjacent roll plug by twisting said cross handle attached thereto.

2. The device of claim 1 including bearing means interposed said roll plugs and said roll-carrying bar to reduce rotational friction therebetween.

3. The device of claim 1 including a pair of noncompressible washers, one on either side of said friction-producing washer to provide smoother rotational friction application through twisting of said handles.

4. The device of claim 1 wherein said roll-carrying bar comprises:

(a) a first roll-carrying tube stub, having one end thereof for attachment to said hand-carrying means;

(b) a second roll-carrying tube stub, having one end thereof for attachment to said hand-carrying means, said first and second stubs axially aligned with their adjacent ends mutually separated;

(c) a first plug, closely fitting the inside diameter of said first stub, anchored inside said free end of said first stub and having an aperture formed axially therethrough;

(d) a second plug, closely fitting the inside diameter of said second stub, anchored inside said hand-carrying means attachment end of said second stub; and, (e) a threaded shaft of smaller diameter than the inside diameter of said first and second stubs axially anchored to said second plug and extending along the axis of said second stub into said first stub and threadably received in said aperture of said first plug to provide adjustable distance between said hand-carrying means attachment ends of said stubs to accept film rolls thereover of various lengths.

5. A portable device for dispensing wrapping film from a roll comprising:

(a) a roll-carrying bar;

(b) a pair of roll plugs rotatably disposed on said bar, each plug comprising:

(1). a first inner roll end insertion portion adapted to fit into the end of the roll to concentrically engage the inside surface thereof;

(2). a second roll end abutting portion attached thereto of greater diameter than the inside diameter of the roll, adapted to abut the end of the roll; and, (3). a flat outer surface formed on the outboard surface of said plug perpendicular to the axis of said roll-carrying bar;

(c) a pair of pins extending from said second roll end abutting portion toward the roll for penetration into the end of the cardboard roll to hold the roll in mating engagement with said plugs;

(d) a first handle bounded at the ends thereof by a pair of arms extending toward the roll, the mutual ends of which are joined to a flat plate attached to said roll-carrying bar perpendicular thereto;

(e) a second handle bounded at the ends thereof by a pair of arms extending toward the roll, the mutual ends of which are joined to a second flat plate threadably received on the other end of said roll-carrying bar perpendicular thereto adapted for rotation in an opposite direction with said first handle to cause said first and second end plates to advance toward each other; and, (f) at least one friction-producing, compressible washer slidably mounted on said roll-carrying bar between said flat plate, attached to said handle, and said outer surface of said adjacent roll plug to cause rotational friction therebetween when squeezed between said surface and said plate.

6. The device of claim 5 including bearing means interposed said roll plugs and said roll-carrying bar to reduce rotational friction therebetween.

7. The device of claim 5 including a pair of noncompressible washers, one on either side of said friction-producing washer to provide smoother rotational friction application through twisting of said handles.

8. A portable device for dispensing wrapping film from a roll comprising a roll-carrying bar, means for rotatably mounting the roll of wrapping film about said bar, means for hand-carrying said bar at each end thereof and means activated by said hand-carrying means for restricting the rotation of the roll about said bar to provide tension to the film as it is being dispensed from the roll, wherein said hand-carrying means comprises:

(a) a sleeve slideably received on one end of said roll-carrying bar and held thereon by a nut threaded on the end of said bar;

(b) a first arm extending from said sleeve;

(c) a cross handle extending from the free end of said first arm;

(d) a second arm pivotally anchored to the other end of said roll-carrying bar and extending therefrom;

(e) a cross handle extending from the free end of said second arm; and, (f) a brake cam formed on said second arm for contact with said means for restricting rotation of the roll to provide tension to the film when one said cross handle is rotated with respect to the other said cross handle.

9. The device of claim 8 wherein said means for hand-carrying said bar at each end thereof comprises:

(a) a first handle bounded at the ends thereof by a pair of arms extending toward the roll, the mutual ends of which are joined to a first flat plate attached to one end of said roll-carrying bar perpendicular thereto; and, (b) a second handle bounded at the ends thereof by a pair of arms extending toward the roll, the mutual ends of which are joined to a second flat plate threadably received on the other end of said roll-carrying bar perpendicular thereto adapted for rotation in an opposite direction with said first handle to advance closer together and to cause contact with said means for restricting the rotation of the roll about said bar.

10. The device of claim 8 wherein said means for restricting the rotation of the roll about said bar comprises at least one friction-producing, compressible washer slideably mounted on said roll-carrying bar between said first arm mounting sleeve and the outer surface of said adjacent roll plug to cause rotational friction therebetween when squeezed between said surface and said sleeve.

11. The device of claim 10 including at least one noncompressible washer adjacent said friction-producing compressible washer.

12. The device of claim 11 wherein said means restricting the rotation of the roll about said bar comprises at least one friction-producing, compressible washer slideably mounted on said roll-carrying bar between said flat plate, attached to said handle, and said outer surface of said adjacent roll plug to cause rotational friction therebetween when squeezed between said surface and said plate.

13. The device of claim 12 including at least one noncompressible washer adjacent said friction-producing, compressible washer.

14. The device of claim 8 wherein said roll-carrying bar comprises:

(a) a first roll-carrying tube stub, having one end thereof for attachment to said hand-carrying means;

(b) a second roll-carrying tube stub, having one end thereof for attachment to said hand-carrying means, said first and second stubs axially aligned with their adjacent ends mutually separated;

(c) a first plug, closely fitting the inside diameter of said first stub, anchored inside said free end of said first stub and having an aperture formed axially therethrough;

(d) a second plug, closely fitting the inside diameter of said second stub, anchored inside said hand-carrying means attachment end of said second stub; and, (e) a threaded shaft of smaller diameter than the inside diameter of said first and second stubs axially anchored to said second plug and extending along the axis of said second stub into said first stub and threadably received in said aperture of said first plug to provide adjustable distance between said hand-carrying means attachment ends of said stubs to accept film rolls thereover of various lengths.

* * * * *